United States Patent [19]

Hausmann et al.

[11] Patent Number: 4,744,403

[45] Date of Patent: May 17, 1988

[54] RETROFITTABLE INSULATING SYSTEM FOR SOLAR ROOMS

[75] Inventors: Scott Hausmann, Brattleboro; Allan McLane, Jr., Marlboro; Daniel B. Bump, Putney; Andrew E. Smith, Brattleboro, all of Vt.

[73] Assignee: Appropriate Technology Corporation, Brattleboro, Vt.

[21] Appl. No.: 4,106

[22] Filed: Jan. 16, 1987

Related U.S. Application Data

[63] Continuation-in-part of Ser. No. 920,563, Oct. 17, 1986, abandoned, which is a continuation of Ser. No. 772,765, Sep. 5, 1985, abandoned.

[51] Int. Cl.[4] ..... A47H 3/00

[52] U.S. Cl. ..... 160/272; 160/310; 160/273.1; 52/86; 52/461

[58] Field of Search ..... 160/271, 272, 268 S, 160/266, 310, 265, 301, 1, 241, 273 R; 52/461, 463, 464, 86

[56] References Cited

U.S. PATENT DOCUMENTS

| | | | |
|---|---|---|---|
| 1,217,561 | 2/1917 | Bunnell | 160/271 |
| 2,023,666 | 12/1935 | Courtright | 160/265 |
| 2,289,100 | 7/1942 | Carroll | 160/265 |
| 2,339,865 | 1/1944 | Larmour | 52/464 |
| 3,051,232 | 8/1962 | Lamb | 160/273 R |
| 3,363,381 | 1/1968 | Forrest | 52/464 |
| 3,460,602 | 8/1969 | Hugus | 160/265 |
| 3,490,514 | 1/1970 | Duncan | 160/310 |
| 3,768,540 | 10/1973 | McSwain | 160/271 |
| 4,064,648 | 12/1977 | Cary | 160/1 |
| 4,347,886 | 9/1982 | Knorring | 160/310 |
| 4,372,367 | 2/1983 | Baldanello | 160/310 |
| 4,390,054 | 6/1983 | Niibori | 160/265 |
| 4,398,585 | 8/1983 | Marlow | 160/271 |
| 4,462,390 | 7/1984 | Holdriege | 126/419 |
| 4,494,707 | 1/1985 | Niibori | 242/67.2 |
| 4,596,093 | 6/1986 | Esposito | 160/272 |
| 4,598,752 | 7/1986 | Esposito | 160/272 |
| 4,606,157 | 8/1986 | Esposito | 160/310 |
| 4,678,019 | 7/1987 | Esposito | 160/272 |

FOREIGN PATENT DOCUMENTS 1379077 10/1961 France .

OTHER PUBLICATIONS

Four Seasons Greenhouses, Built-In Shading System Installation and Assembly Manual.

Brochure of the John Boyle & Co., "Constant Tension and Mechanism".

Brochure, John Boyle, Constant Tension Mechanism, Jun. 1983.

*Primary Examiner*—Reinaldo P. Machado

*Attorney, Agent, or Firm*—Wolf, Greenfield & Sacks

[57] ABSTRACT

A retrofittable insulation system for solar rooms having glass bays supported by sills along the bottom and separated by vertically extending glazing bars. The system includes extruded, plastic double channel tracks secured to the inside of the glazing bars and extending substantially the full length thereof. An insulating shade sheet is carried by a roller supported on brackets mounted at the tops of adjacent glazing bars. The shade sheet has corded edges captured within the channels of the tracks and a batten is secured to its lower edge. Spring motors are mounted on the sill adjacent the bottom of each track, and cables connect the spring motors to the ends of the batten. The shade is operated by an actuator connected to the shade roller, which acts against the spring motors. In a preferred embodiment, the spring motors exert a pull force on the shade that varies in accordance with the force required to retract the shade which is a function of the relative position of the shade in the tracks.

19 Claims, 8 Drawing Sheets

RETROFITTABLE INSULATING SYSTEM FOR SOLAR ROOMS

CROSS REFERENCE TO RELATED APPLICATIONS

This application is a continuation-in-part of our application Ser. No. 920,563 filed Oct. 17, 1986, which is a continuation of our application Ser. No. 772,765 filed Sept. 5, 1985, now abandoned.

FIELD OF THE INVENTION

This invention relates generally to shades for solar rooms and more particularly to a retrofittable insulation system which may be applied to an existing structure.

BACKGROUND OF THE INVENTION

At the present time there are at least three types of shade systems designed for use in greenhouse-type solar rooms. One system uses folded shades with each fold connected at one point to tracks along the sides. These shades are not efficient insulators because the side edges of each fold are not sealed throughout their length to the tracks. Furthermore, the folds frequently become unsightly due to the lack of uniformity of the folding action, particularly when the shades are retracted.

Another system employs tracks that are build into the glazing bars that separate the adjacent vertical glass bays. Because the tracks are built into the glazing bars, the system is not suitable for retrofitting into existing structures but rather must be included in the structures when initially built. Similarly, the system employs spring motors which are built into the sills. Thus, both the sills and glazing bars are fairly complex structures and are rather large, which results in increased costs to the purchaser. The purchaser of a structure which incorporates this system has to pay for the special glazing bars and sills whether or not he wants the insulating shade system. Another disadvantage of this system is that the shade material is required to enter the tracks which are incorporated into the glazing bars at an acute angle, which interferes with the smooth operation of the system.

Yet another system found in the prior art employs large, heavy metal tracks which are secured to the glazing bars. The metal tracks must be factory bent to the exact curve of the greenhouse glazing bars, as they are not capable of being bent at the site. Consequently, the tracks must be manufactured to rather precise specifications, which has an adverse effect upon their cost. This system also employs large weights for drawing the shades down the tracks, and these weights are quite unsightly, as they are normally suspended in the middle of the greenhouse bays.

Heretofore, the use of plastics in the manufacture of tracks has been avoided, as people in the industry believed that regardless of the plastic composition, the tracks would deform under the heating and cooling cycles to which they are subjected, particularly when the tracks were mounted in long sections of 20 feet or more, Furthermore, it has been generally assumed that plastic materials could not withstand the high temperatures and ultraviolet exposure, present in the high temperatures and ultraviolet exposure, present in sunroom areas.

Many conventional shading systems for sun rooms, particularly the second system described hereinabove, employ a spring device, such as a spring motor, to retract the shade material over the glazing surfaces. These spring motors generally use a conventional zero gradiant or constant force spring. Such constant force springs exert on the partially retracted shade material a generally constant pull force and a torque which increases at a relatively constant rate over a narrow range as the cable is extended. However, the pull force actually required to retract the shade is not constant but varies depending upon the position of the shade in the tracks, or, upon the length of cable withdrawn. For most such systems, the pull force required to retract the shade increases slowly until about half of the cable is withdrawn. Thereafter, at some point, depending upon the particular shade configuration, the amount of pull force required to retract the shade decreases substantially, Since the constant force spring must be designed to provide a pull force which at all times is greater than the maximum force required to retract the shade, a large disparity exists between the pull force actually required to retract the shade and the actual pull force exerted. As a result, an unnecessary strain is placed upon the shade material and upon other components of the system. Typically, these constant force springs are produced by deflecting the spring material to an equal degree along the entire length of the spring so that each section has an essentially constant coil diameter.

The principal object of the present invention is to provide a retrofittable system that can be easily measured and installed in the field, that is easy to ship, that works well, and that is not too costly.

Another object of the present invention is to provide a retrofittable insulating shade system for greenhouse-type rooms, which operates smoothly, and which makes use of sealed, tracked, insulating window shades which will render such rooms substantially immune from the extreme cold of winter and the extreme heat of summer, and provide privacy when desired, so as to enhance the enjoyment provided by such greenhouse-type sun rooms.

A further object of the present invention is to provide a spring motor for a retrofittable insulating shade system in which the profile of the curve of the actual pull force exerted on the shade material at each position of the shade conforms to the profile of the curve of the pull force actually required to retract the shade.

SUMMARY OF THE INVENTION

To accomplish these and other objects, the insulation shade system of the present invention includes elongated channel tracks extruded from a very strong plastic material such as Lexan, which are adapted to be secured on the inner face of the glazing bars of a greenhouse-type solar room. The tracks which separate adjacent glass bays have a double channel with each channel serving one side of one of the adjacent bays. A roller carrying an insulating shade sheet is mounted at the top of the bay, and the edges of the sheet are corded with the cords captured within the channels of the tracks on each side. The lower edge of the shade sheet carries a batten, the ends of which are connected to cables which extend downwardly from the battens through the channels to spring motors that are mounted adjacent the bottoms of the tracks on the sill of each bay. The spring motors form part of a spring motor subassembly which is rather small and unobtrusive when mounted in place on the sill. The roller that carries the shade sheet may be automatically or manually operated so as to place the shade sheet at the desired position. The spring motors bias the shade to the fully drawn position, and the manual or automatic means for operating the shade sheet roller acts against the bias of the spring motors to partially or fully retract the shade sheet.

In a preferred embodiment, a spring is provided in the spring motor which produces a variable pull force on the shade material. Preferably, the profile of this variable force is tailored to conform to the profile of the pull force actually required to retract the shade, so that no unnecessary strain is placed on the shade material and other components of the system. Such a variable torque spring is tailored to the needs of a particular shade system, and is produced by intentionally deflecting the spring to varying degrees along its length so that the coil diameters vary from point to point.

BRIEF DESCRIPTION OF THE DRAWINGS

The objects, advantages and features of this invention will be more clearly appreciated from the following detailed description when taken in conjunction with the accompanying drawings in which.

DETAILED DESCRIPTION

Figure 1:
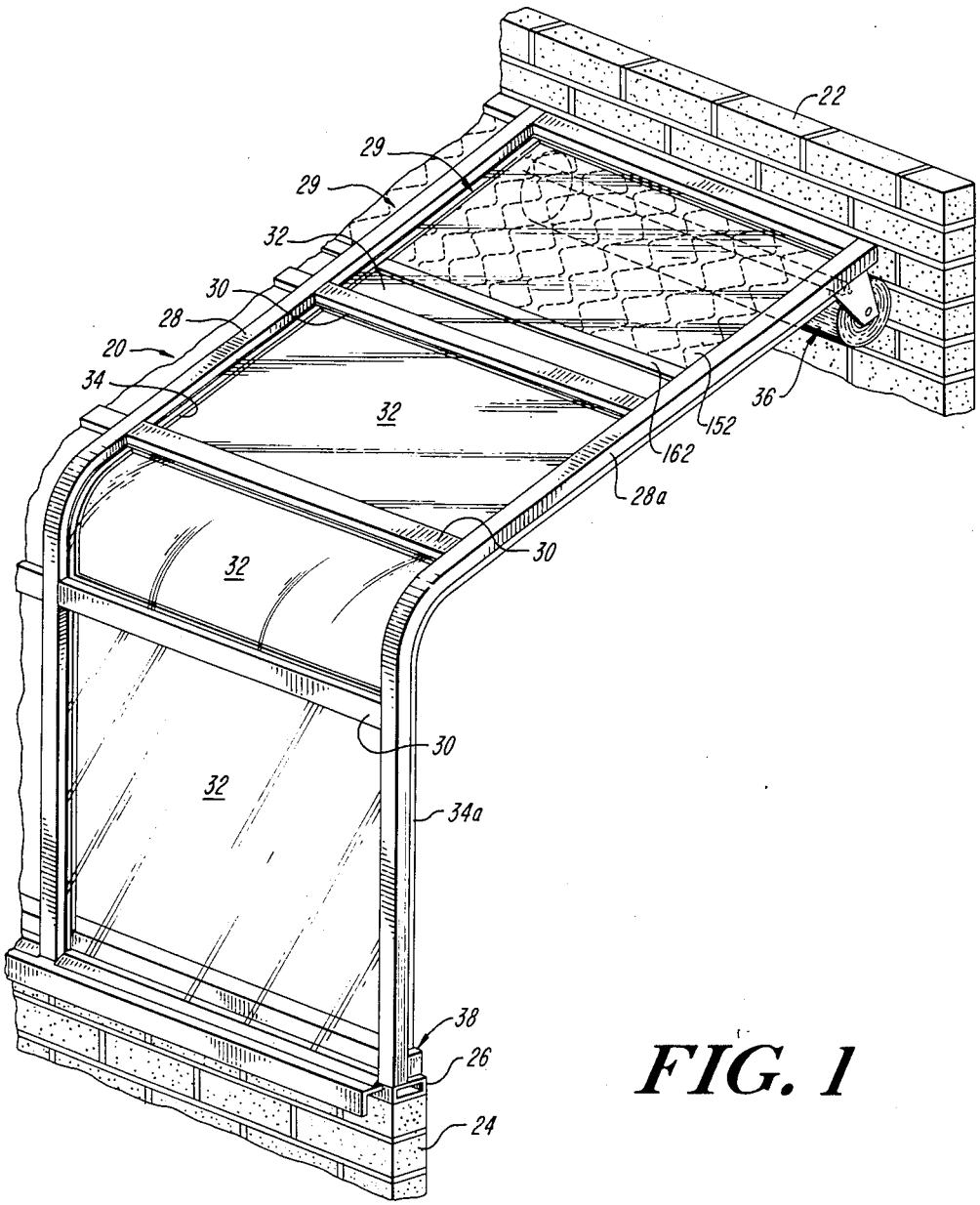
FIG. 1 is a fragmentary perspective view of one bay of a solar room, viewed from outside the room, having an insulating shade assembly in accordance with this invention.

In FIG. 1 a portion of the solar room is shown enclosed by a solar wall 20 which extends from interior wall 22 (outside structured wall of a dwelling) to the solar sill wall 24 which carries the sill 26. A number of parallel glazing bars 28 extend upwardly from the sill 26 in a generally vertical direction and then turn upwardly and inwardly toward the exterior surface of the dwelling wall 22. The glazing bars 28 separate adjacent bays 29 of the wall 20 and are disposed at the ends of the wall 20 as well. The glazing bars 28 are in turn interconnected by a number of parallel, horizontal mullions 30 that divide the bays into a number of rectangles which are filled by glass or plastic transparent panels 32. The details of the solar room form no part of the present invention and may take any form. The present invention provides a retrofittable insulation system for the bays and their panels so as to shield the room from the extreme cold of winter and heat of summer and at the same time provide privacy for the solar room.

The retrofittable system which is applied to the solar wall 20 includes three major subassemblies for each of the bays 29, namely, the track units 34 and **34*a*, the insulating shade and roller subassembly 36 and the spring roller and sill box assembly 38**. They are each separately described in detail below.

Track Units 34 and 34*a*

Figure 2:
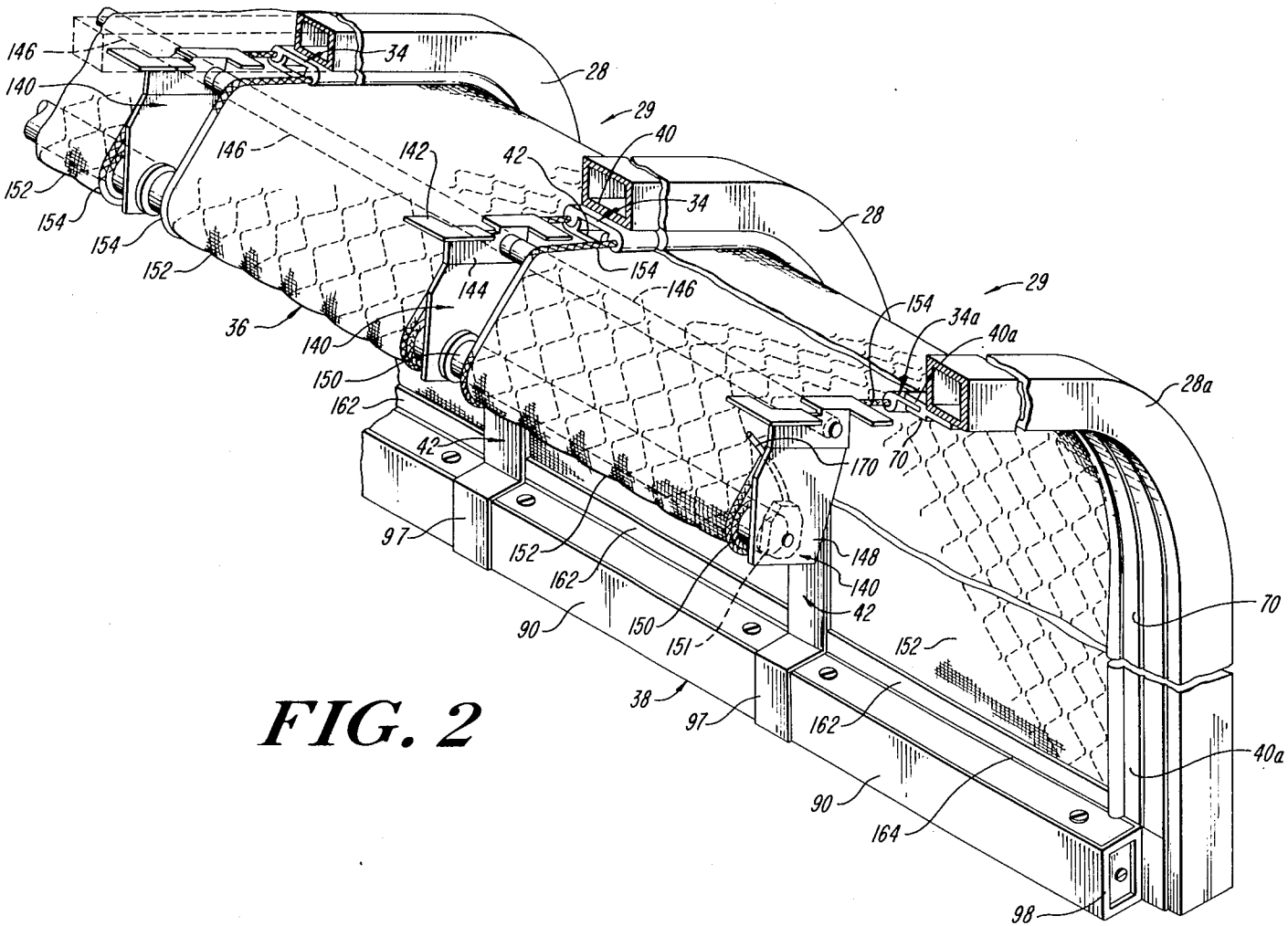
FIG. 2 is a fragmented perspective view of the insulating shade assembly of this invention showing how it is applied to several bays of a solar room.
Figure 3:
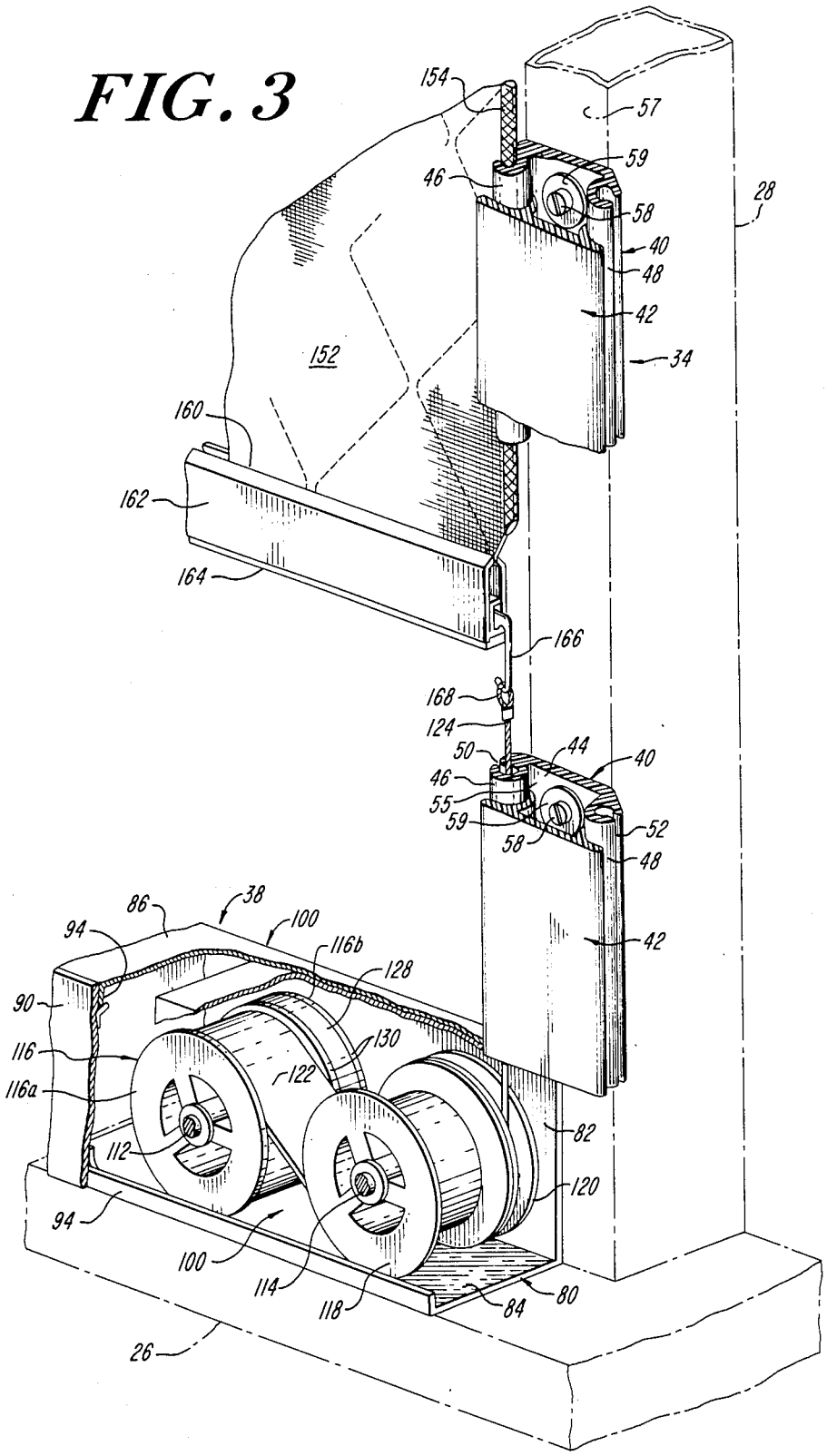
FIG. 3 is a fragmentary perspective view of one side of one shade assembly viewed from inside the solar room.
Figure 5:
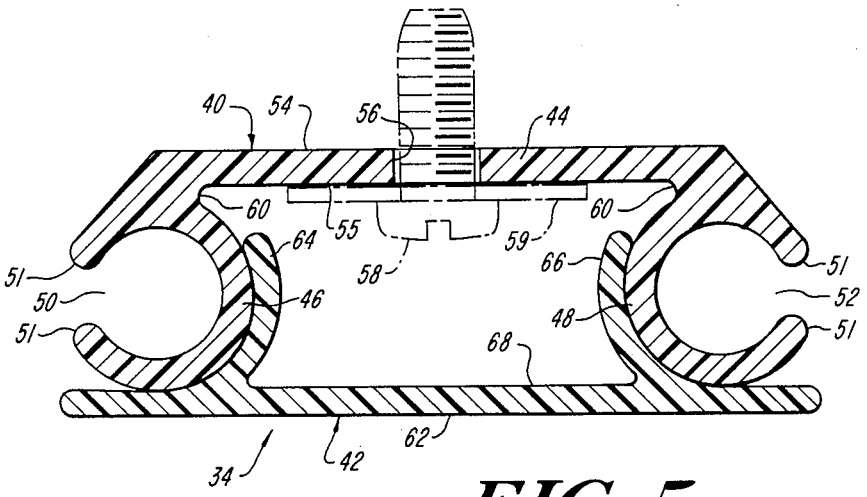
FIG. 5 is an enlarged cross-sectional view of a double track and cover forming part of the system and shown in FIGS. 2 and 3.

The track unit 34 shown in FIGS. 2, 3, and 5 is composed of two parts, namely, track 40 and cover 42. The track 40 is a plastic extrusion made of Lexan, which is a registered trademark of the General Electric company for a polycarbonate product, or some comparable plastic material having sufficient strength, rigidity and other properties to perform its intended function. The track includes a base 44 and two oppositely facing C-shaped channels 46 and 48 that lie at opposite ends of the base 44 but on the same side thereof. The openings 50 and 52, respectively, of the channels 46 and 48 face away from one another and are accessible in planes essentially parallel to the base. Typically the wall thickness of base 44 and channels 46 and 48 is 0.080 inch while the inner radius of each channel is 0.180 inch. In its preferred form, the overall width of the track is approximately 2.00 inches and the centers of the channels 46 and 48 lie approximately 0.360 inch from the plane of the rear surface 54 of the base. Spaced along the center line of the base 44 preferably approximately six inches from center to center are slots 56 through which fasteners extend to secure the track 40 to the inner face of a glazing bar 28. As shown in FIGS. 2 and 3 the rear surface 54 of the track 40 is applied directly to the inner face 57 of glazing bar 28 by means of metal screws 58 with washers 59 that extend through the slots 56. The space between the two channels 46 and 48 is sufficient to accommodate the washers 59 so that the track may be secured firmly to the glazing bar surface 57.

It will be noted in FIG. 5 that full radii are formed at the margins 51 of the channel openings 50 and 52 so as to prevent the track channels 46 and 48 from tearing or catching the shade sheet material, as is described in greater detail below. It will also be noted in FIG. 5 that the juncture between the channels 46 and 48 and the base 44 are enlarged by radii 60 to strengthen the extrusion.

The track cover 42 is also a plastic extrusion typically made of Lexan or some similar, comparable material. The track cover includes a front plate 62 and a pair of oppositely curved flanges 64 and 66 that extend from the rear face 68 of the plate 62. Typically, the wall thickness of the plate 62 and the flanges 64 and 66 may be 0.060 inch, and the overall width of the cover 42 is the same as the track 40, typically 2.00 inches. The curvature and position of the flanges 64 and 66 are selected so that they may snap between and bear firmly against the closed sides of the channels 46 and 48 opposite the openings 50 and 52 so as not to interfere with the function of the channels. The flanges 64 and 66 possess sufficient flexibility to allow the covers to be removed and remounted when desired. As will be noted in FIG. 3, the cover 42 when mounted on the track encloses the front face 55 of track base 44 so as to cover the screws and washers 58 and 59 that hold the track on the glazing bar. Thus, the cover provides the track units with a finished and attractive appearance. Because the track units are relatively small, they are unobtrusive so as not to detract from the appeal or appearance of the solar room even when the shades are not drawn.

In accordance with the present invention, a single length of track is applied to each of the glazing bars 28 disposed between adjacent bays 29 in the wall 20 and extends substantially the full length thereof from the sill 26 to the interior wall 22. As suggested above, the track 40 and track cover 42 may be made of Lexan or other high temperature, fire retardant, U-V resistant polycarbonate. The track 40 without the cover is flexible enough so that it may be bent at the site to conform with the configuration of the glazing bar to which it is mounted. The track and cover may be extended in approximately 24 foot lengths so that a single piece of the track may extend uninterrupted from the wall 22 to the sill 26. The track and cover may be cut to length with a hacksaw and the track 40 may be screwed into the glazing bars at predrilled holes after which the cover 42 may be snapped in place so as to hide the screws and washers which hold the track in place. Normally, the glazing bars are less than three inches in width, and the track unit which preferably is only two inches wide will fit conveniently on any glazing bar separating two adjacent bays.

Figure 6:
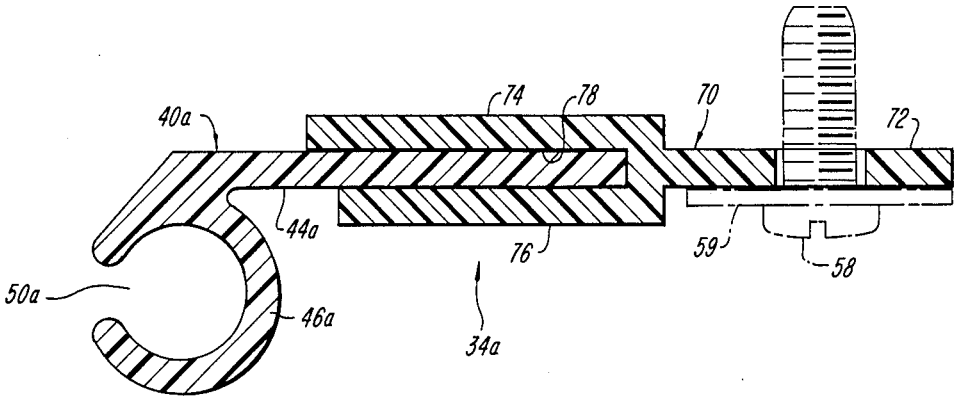
FIG. 6 is an enlarged cross sectional view of a single track and retainer forming part of the system.

The glazing bars **28*a* at the end of wall 20 carry a half track 40*a* as shown in FIGS. 2 and 6. The half track 40*a* is essentially the same as the track 40 but lacks one of the channels. A Y-shaped retainer strip 70 may be screwed to the end glazing bar 28*a* to engage the base of the half track and hold it in place. The retainer strip 70 includes a flange 72 which in turn carries two parallel arms 74 and 76 that define a slot 78 between them which receives the base 44*a* of the half track 40*a*. The half track 40*a* has a single C-shaped channels 46*a* disposed along one edge thereof virtually identical to one of the channels 46 or 48 carried by the base 44 in the track 40 shown in FIG. 5. The retainer strip 70 allows the half track 40*a* to be slipped into place after the retainer is secured to the glazing bar. The C-shaped channel 46*a* has an opening 50*a* which faces in a direction parallel to the glass panels of the bay and toward the channel of the double track unit 34** on the next glazing bar in the wall structure.

The plastic tracks 40 and **40*a*** reduce friction between the shade panels so as to enhance the operation of the shades and allow for the use of smaller spring motors which bias the shades to the drawn position as will be explained more fully below.

Spring Motor and Sill Box Subassembly 38

Figure 4:
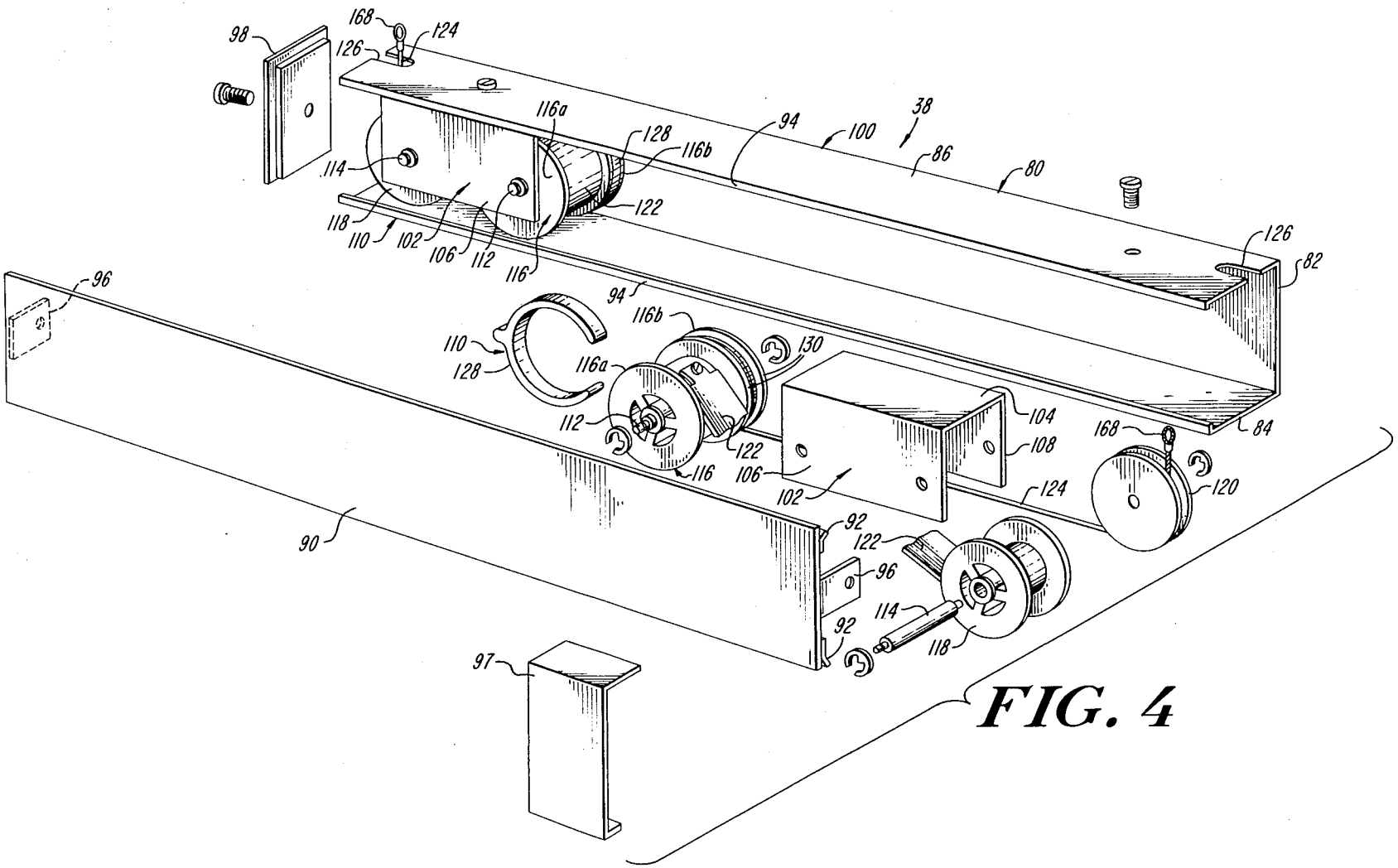
FIG. 4 is an exploded perspective view of the spring motor assembly shown in FIG. 3.

The spring motor and sill box subassembly 38 includes a U-shaped channel 80 oriented on its side as shown in FIGS. 3 and 4. The channel that defines a part of the sill box 100 has a rear wall 82 and parallel flanges 84 and 86 with the flange 84 as shown in FIG. 3 disposed horizontally and resting on the sill 26 of the window wall. In the preferred form, one channel section 80 is provided for each bay of the window wall, but when in place, the several channels for the several bays may form a continuous housing for the spring motor mechanisms. The channels may be secured to the glazing bars and/or sill as desired.

The sill box 100 includes a cover 90 which encloses the two spring motors that are connected to each side of the shade sheet, as described below. The cover 90 has a pair of short flanges 92 which cooperate with the lips 94 on the free edges of the flanges 84 and 86 of the channel to center the cover on the open side of the channel. The cover 90 carries a bracket 96 at each end that screws into the end caps 98 which close the ends of the sill box 100 so as to complete the enclosure for the spring motors. U-shaped brackets 97 are provided to cover the abutting ends of the sill box sections 100 of each bay, as shown in FIG. 2.

A motor yoke 102 having a top wall 104 and front and rear walls 106 and 108 is mounted at each end of the sill box on the top flange 86 of the channel 80 and supports a spring motor 110. The two spring motors 110 mounted in each sill box are mirror images of one another, that is, their parts reversed, and only one is described.

A pair of parallel, horizontal spool shafts 112 and 114 are supported in the vertical walls 106 and 108 of the motor yoke 102. Shaft 112 supports a combined spring and cable spool 116 while shaft 114 supports a second spring storage spool 118 and an idler sheave 120. A motor spring 122 is wound in one direction about the spool 116 and the other direction about spool 118, and when wound onto spool 116, the bias of the spring urges the spool 116 to turn in a clockwise direction as viewed in FIG. 3. Spring 122 is wrapped about storage spool 118 to conform to its direction of curvature and about spool 116 opposite of its direction of curvature. As is evident in FIG. 4, the spool 116 has a wider section **116*a* on which the spring is wound and a narrower section 116*b* at the rear of shaft 112 which stores a cable 124. The cable on the section 116*b* is wound in a counter-clockwise direction and extends from the spool section 116*b* about the idler sheave 120 and through a slot 126 cut in the edge of the top flange 86 of the channel 80. A cable retainer 128 fits within the flanges 130 of the spool section 116*b*** and surrounds the cable stored on it.

It will be noted in FIG. 3 that the idler sheave 120 is positioned in tangential alignment with the center of channel 46 so that the cable 124 may extend into the channel without binding on its bottom edge. The spring motors on each side of the bay are similarly positioned so that the two cables are hidden from view when the shade system is installed.

The cables 124, however, may be withdrawn from the spools about the idler sheaves so as to extend vertically above the sill box 100. The ends of the cables, as described below, are connected to the ends of the batten carried by the shade sheet. As the cable is withdrawn from section **116*b*, spring 122 unwinds from storage spool 118 and becomes wound on section 116*a* to bias spool 116 in a clockwise direction for rewinding of the cable, as viewed in FIG. 3. As the cable is completely rewound on section 116*a*, spring 122 returns to storage spool 118 in its normal position, relieving the bias on spool 116**.

In one embodiment of the spring motor, spring 122 can be a conventional, constant force spring. Such springs may be purchased from Vulcan Spring And Manufacturing Company, 501 School House Road, Telford, Pennsylvania 18969. In such motors, the torque or force applied to the shade to retract it remains relatively constant regardless of the position of the shade, or regardless of the amount of cable withdrawn during both extension and retraction of the cable. Because the effective radius of the spring about spool 116 increases as the shade is raised, the actual torque about shaft 112 increases as well in a constant force spring. Thus, the torque applied increase slowly and steadily as spring 122 becomes wrapped about spool 116 as the shade is raised. In one example, the torque applied ranges from 4.8 inch/pounds with the cable fully retracted, to 5.5 inch/pounds with the cable fully extended.

Figure 8:
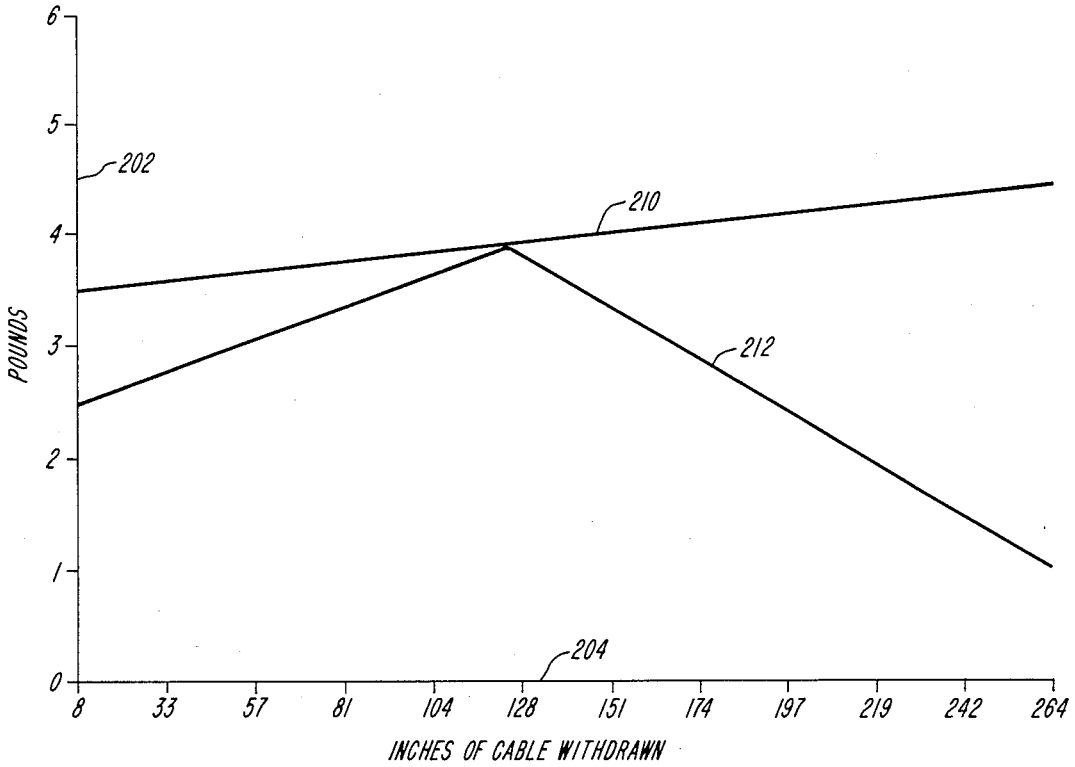
FIG. 8 (PRIOR ART)
FIG. 8 is a graph with two plots, one plot showing the pull force in pounds exerted by a constant force spring versus the inches of cable withdrawn, and a second plot showing the pull force in pounds actually required to retract the shade versus the inches of cable withdrawn.

One drawback of such prior art constant force springs is that the straight line profile of the pull force actually applied to the shade does not neccessarily conform to the curved profile of the pull force required to retract the shade material over the glazing surface. An exemplary situation is shown in FIG. 8 which is a graph in which the ordinate axis 202 shows the force in pounds and the abscissa 204 represents the inches of cable withdrawn from section **116*b* of spool 116. This particular example is for a 30 inch wide shade which is 264 inches long and which utilizes a constant force spring motor. Line 210 is a plot showing the pull force actually applied to the shade material by the constant torque motor as the cable is withdrawn. Line 212 is a plot illustrating the pull force required to retract the shade material as the cable is withdrawn. As can be seen from FIG. 8, the spring motor must be confirgured to apply a pull force greater than the maximum required to retract the shade material at any position on the tracks. A shown in FIG. 8, with a constant torque motor, the pull force applied (210) increases at a constant rate within narrow limits as the cable is withdrawn. In contrast, the pull force required to retract the shade material (212) increases until the shade is approximately one half raised, at which point, the maximum force is required. Thereafter, the requird pull force decreases to a minimum when the cable is completely withdrawn. FIG. 8** illustrates that, except at about the one half raised position, the pull force actually exerted on the shade material by a constant force spring motor greately exceeds the pull force required to retract the shade. At the time when the pull force exerted is at its peak, the pull force actually required to retract the shade material is at its minimum. As a result, unnecessary strain is placed upon the shade material and upon other components of the system.

Figure 9:
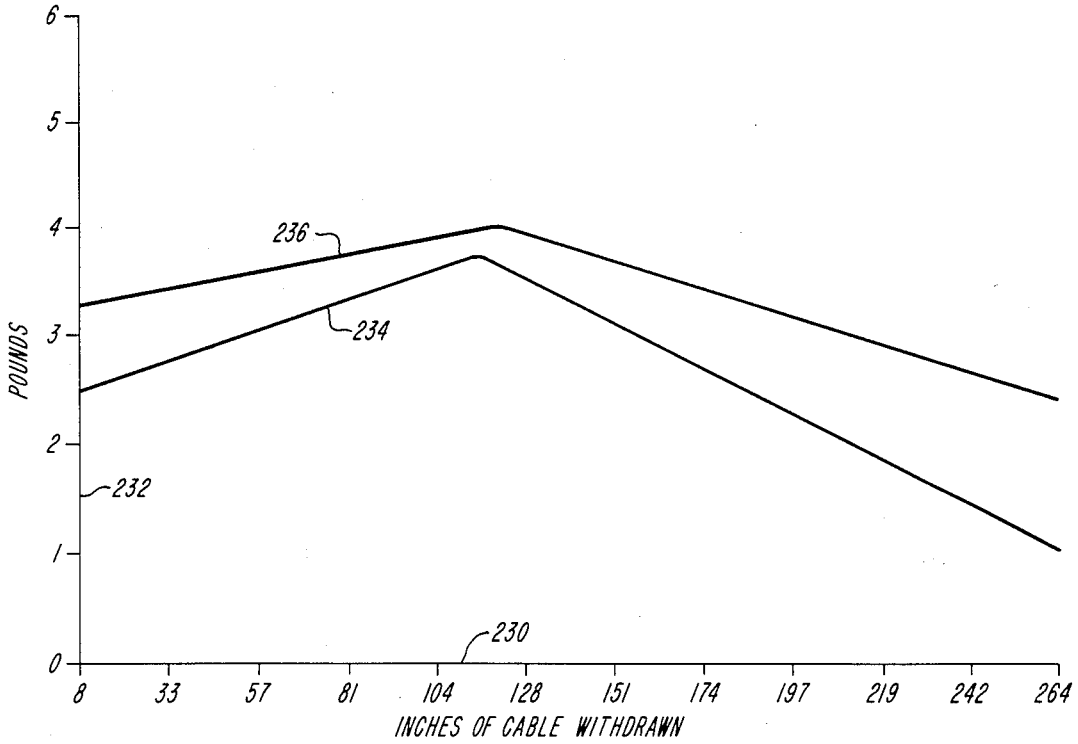
FIG. 9 is a graph illustrating one embodiment of the variable torque spring of the present invention and having two plots, one plot showing the pull force in pounds exerted on the shade versus the inches of cable withdrawn, and the other plot showing the pull force in pounds required to retract the shade versus the inches of cable withdrawn.

In a preferred embodiment of the present invention, this drawback of conventional, constant torque spring motors is overcome by the use of a sping motor using a spring 122 which delivers a variable torque. A profile for a typical variable torque spring motor according to this invention is shown in FIG. 9. FIG. 9 again is illustrative for a shade 30 inches by 264 inches. FIG. 9 is a graph having an abscissa 230 which indicates the number of inches of cable withdrawn from section **116*b* of spool 116. The ordinate 232 is force in pounds. Plot 234 shows the profile of the pull force actually required to retract the shade material as the cable is withdrawn. Plot 236 shows the profile of the pull force actually exerted by a variable torque spring motor as the cable is withdrawn. It can be seen immediately from FIG. 9 that the profile for the pull force available to retract the shade material closely parallels the profile of the pull force required to retract the shade material. The only point where there is some divergence of plots 234 and 236 is at the point where the shade is almost fully raised. The thickness of the spring 122 places practical limits on the amount the pull force can be varied, especially where the shade is totally raised and the spring diameter is almost flat. The pull force available is slightly greater than the required pull force at all points to facilitate smooth operation of the system, and to accommodate emergencies such as any unexpected jamming or an increase in friction. Typically, in the example shown, the pull force available should exceed the pull force required by about at least $\frac{1}{4}$ to $\frac{1}{2}$ pound as a safety factor. However, this safety factor can be any amount desired. As can be seen from FIG. 9**, the spring motor conforms to the needs of the system, thereby minimizing any unnecessary strain placed on the shade material or on other components of the system.

Figure 10:
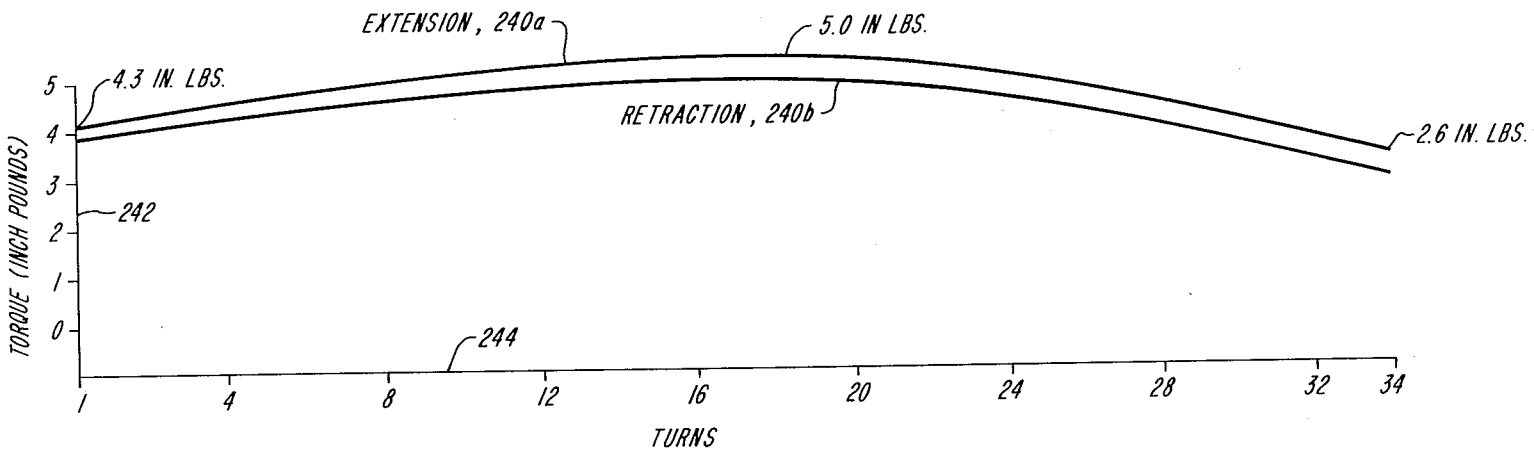
FIG. 10 is a graph showing torque exerted by an exemplary variable torque spring of the invention during extension and retraction of the shade.

The torque produced by the exemplary spring motor illustrated in FIG. 9 is shown in FIG. 10. FIG. 10 is a graph whose ordinate 242 is torque in inch/pounds and whose abscissa 244 is the number of turns of the spring on spool section **116*a*. For a shade 264 inches long, in this example, 34 turns are required. Plot 240*a* shows the torque produced versus the turns of spring 122 about spool section 116*a* as the cable is extended. The torque varies from 4.3 inch/pounds at one turn, to a maximum of 5.0 inch/pounds at about 16 turns to 2.6 inch/pounds at 34 turns. Plot 240*b* shows the torque produced versus the turns of spring 122 about spool section 116*a* as the cable is being retracted. The slight differences between plots 240*a* and 240*b*** are due to spring inefficiency and friction.

In order to develop the proper profile for a variable torque spring 122, the pull force requirements of the system first must be determine. Once these pull force requirements have been determined, the profile required for the variable torque spring can be defined simple by supplementing the pull force required by a predetermined amount to provide the required margin of safety. The variable torque is produced by deflecting the spring material by varying degrees at different points along its length. Thus, where a greater pull force is required, the spring is deflected to a greater extent, or in other words, is provided with a curvature having a smaller radius. Various sections along the spring are provided with different radii of curvature, depending upon the pull force desired at that particular point in the spring. This is in contrast with a constant force spring in which each section along its length has an essentially constant radius of curvature of is deflected to an equal degree. Such variable torque springs can be produced to the desired specifications by Vulcan Spring And Manufacturing Company.

As an example, the constant torque spring illustrated in FIG. 8 is provided with a coil diameter of about 0.70 inch at each turn, or at each position along its length. For the exemplary variable torque spring illustrated in FIGS. 9 and 10, the coil diameter at one turn is about 0.90 inch, at 16 turns is about 0.70 inch, and at 34 turns is about 1.85 inches.

Preferably, the diameter of storage spool 118 should be such that the innermost coil of spring 122 fits snugly on spool 118. This relationship is particularly desirable for a variable torque spring, since the outer coils tend to distort the inner coils if not fully supported, because of the smaller diameters of the outer coils. For the exemplary springs previously described in FIGS. 8–10, a preferred diameter for spool 118 for a constant torque spring is 1.38 inches while a preferred diameter for spool 118 for a variable torque spring is 2.1 inches. This increase in the spool diameter for a variable torque spring significantly prolongs the life of the spring motor 110.

The spring motor assembly described provides several advantages when used in the present system. For example, the idler sheave 120 shares a common axle with the spring spool 118 so as to reduce the size of the assembly. The idler sheave 120 does not add height to the assembly nor does it add to its depth. Because the spring motor and sill box assembly is relatively small, the sill 26 need not be large so as to disturb the aesthetics of the structure, which would of course occur particularly when an insulating shade system is not applied. In the preferred form of the present invention, the sill box is approximately 3.25 inches in height and 2.125 inches in depth, but yet the arrangement is such that the spring motors are capable of drawing in up to 24 feet of cable so as to enable the shade to operate over the entire window surface. Moreover, the spring motors are sufficiently narrow from end to end so that two may be contained within a sill box only 12 inches in length. Therefore, the shade system can accommodate a very narrow bay.

Insulating Shade and Roller Subassembly 36

Figure 7:
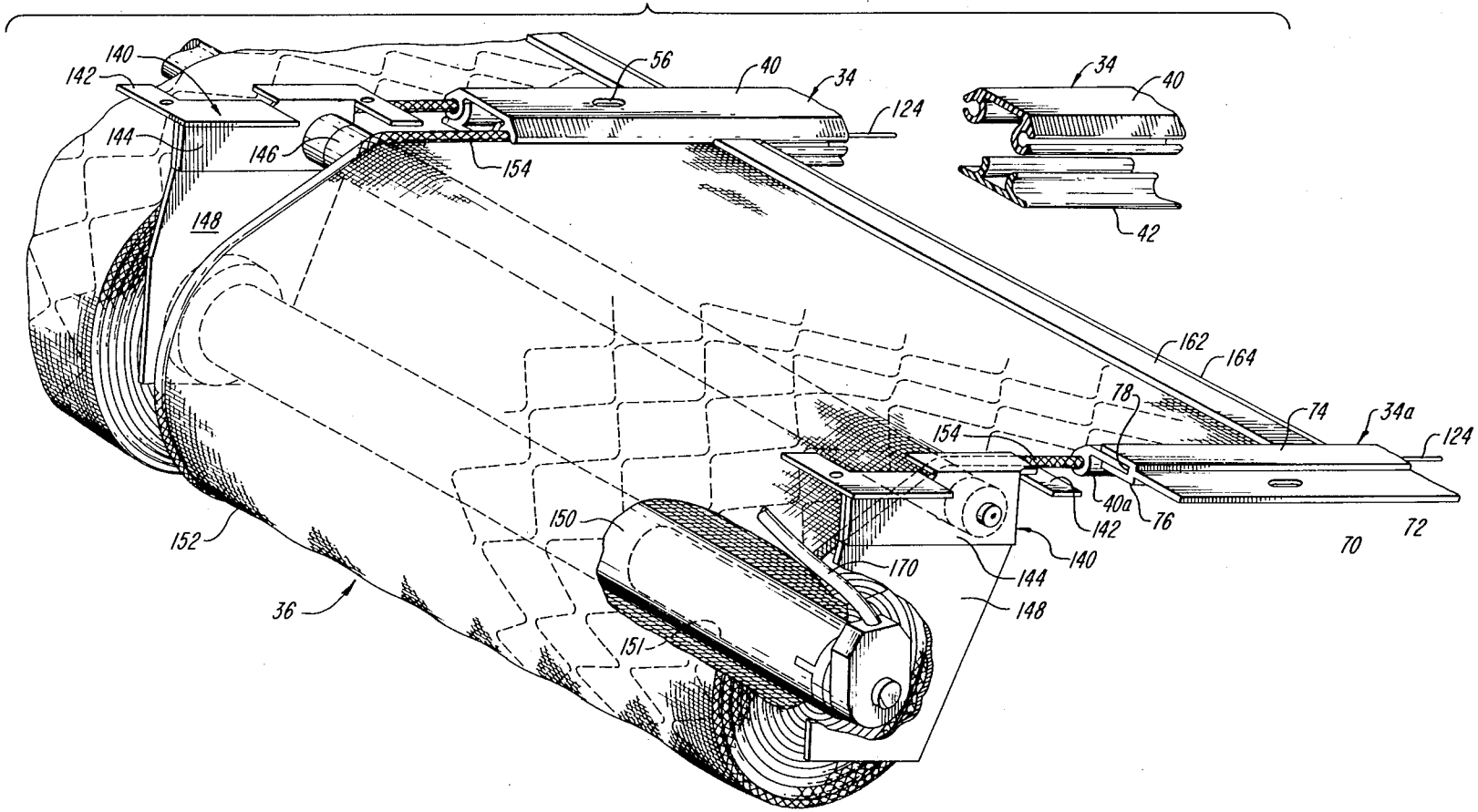
FIG. 7 is a fragmentary partially exploded perspective view of the shade and roller assembly for one bay of a solar room.

The insulating roller and shade subassembly 36 is shown in detail in FIGS. 2 and 7. One roller and shades subassembly is supported at the upper end of the glazing bars on each side of each bay by a pair of stub brackets 140 mounted on the lower surfaces (inner surfaces) of the glazing bars 28 and/or 28*a* immediately beyond the top ends of the tracks 34 and/or 34*a*. Each stub bracket 140 has a horizontal flange 142 that is secured directly to the glazing bar and also includes a vertical wall 144 which supports both an idler guide roller 146 and the motor tube and take-up roller support bracket 148. The bracket 148 carries the take-up roller 150 for the shade sheet material which in turn contains, in the preferred embodiment, an electric motor assembly 151 for operating the take-up roller. The details of the motor assembly 151 for driving the take-up roller from no part of the present invention and it is not illustrated. It is sufficient to state that such motor-driven rollers are well known in the art such as the Somfy take-up roller motor manufactured by Somfy Systems, Division of Carpano & Pons, Inc., Edison, New Jersey. In FIG. 7, a power cord 170 is shown connected to the motor. Alternatively, the take-up roller 150 may be operated manually by cords and pulleys which are also conventionally used to operate shade and insulating sheets.

The insulating shade sheet 152 carried by the roller 150 may be of a variety of types and typically may be a multi-layered sheet material which blocks air movement and moisture with the layers being ultrasonically welded together in a quilted pattern. An example of a suitable material is sold under the trademark WINDOW QUILT by Appropriate Technology Corporation, Brattleboro, Vermont. The shade sheet has corded edges 154 along both sides which fit within the channels of the track units 34 and 34*a* as is described more fully below. The shade sheet 152 carried by the take-up roller 150 extends about the idler guide roller 146 that aligns the sheet with the channels 46 and 48 in the tracks to minimize the angle of entry of the corded edges 154, which is clearly shown in FIG. 7.

The free edge 160 of the shade sheet carries a batten 162 preferably having a cushioned bottom surface 164 which engages the top flange 86 of the sill box 100 when the shade is fully drawn (see FIG. 3). The batten 162 carries a hook 166 at each end that engages a loop 168 in the end of a cable 124 of the spring motor. Preferably the batten 162 is made of Lexan or other suitable plastic material having the same properties as the track units 34 and 34*a* so as to withstand the high temperature variations and ultraviolet exposure to which they are regularly subjected. If desired, a steel rod may be placed within the batten 162 (note in FIG. 3 that it is hollow) so as to add stiffness to it. The need for such a stiffening member will be determined by the width of the shade sheet.

The Assembly

The various components of the insulating shade system described above are particularly designed so as to permit it to be installed on existing structures. The sill boxes 100, tracks 34 and 34*a* , and the brackets 140 and 148 which support the shade take-up roller 150 and idler guide roller 146 may be conveniently mounted on the sill 26 and glazing bars 28 with conventional fasteners. The plastic tracks which have a low friction contact with the shade edges promote better and smoother operation of the shades and allow for the use of relatively small spring motors.

After the sill box 100 with the spring motors 110 are mounted on the sill 26 (by attachement to the sill or glazing bars) and the brackets 140 and 148 are mounted on the top ends of the glazing bars, the track units 34 and 34*a* are mounted on the bars 28 and 28*a* , the leading ends of the corded edges 154 of the shade are then introduced into the upper ends of the channels 46 and 48 of the tracks disposed on each side of each bay being covered, and the hooks 166 at each end of the batten 162 are connected to the loops 168 at the ends of the cables 124 of the spring motor. The positions of spring motor 110 are fined tuned so that the idler sheaves are tangentially aligned with the channels to avoid any binding of the cables in the track channels. As is evident in FIG. 3, both the corded edges 154 and the cables 124 along with the hooks 166 are normally disposed in the channels of their respective tracks and are hidden from view. The batten 162 is somewhat narrower than the full width of the shade sheet including the corded edges 154 so that the edges of the batten lie outside the channels. Therefore, the battens 162 do not interfere with the smooth operation of the system. Once the assembly is completed, if a motor-driven take-up roller is provided, it may be operated by a conventional electric switch (not shown) connected to the motor circuit which includes power cord 170.

In the preferred form of this invention, each bay of the window wall is provided with its own essentially independent system including its own sill box with two spring motors, either motor-driven or manually operated take-up roller and shade, and the channels of its adjacent track units. When the wall includes more than one bay, the take-up rollers of the adjacent bays may, if desired, be coupled together so as to be driven by a single actuating mechanism such as a motor drive 151. Moreover, particularly when the bays are very narrow, a single system may cover more than one bay, in which case the shade sheet will span an intermediate glazing bar for which a track unit is omitted.

Having described this invention in detail, those skilled in the art will appreciate that numerous modifications may be made of the present invention without departing from its spirit. Therefore, it is not intended that the breadth of this invention be limited to the single embodiment illustrated and described. Rather, the scope of this invention is to be determined by the appended claims and their equivalents.

What is claimed is:

1. A retrofittable insulation system for solar rooms having a window wall defined by a generally horizontally extending sill, one or more horizontally extending mullions and at least two vertically extending glazing bars which describe the sides of a window bay and separate adjacent bays comprising:

a pair of elongated tracks formed of a plastic material, each of said tracks being adapted to be secured to the inside of a glazing bar on each side of a window bay and extending substantially the full length thereof, each of said tracks having at least one channel open to the side of said track and a base to facilitate securing of said track to a bar;

a take-up roller bracket secured adjacent the top of each bar and carrying a take-up roller, said take-up roller carrying an insulating shade sheet having a lower edge;

a corded edge provided on each side edge of the shade sheet, each of said corded edges extending into a channel in one of said tracks;

a batten secured to said lower edge of said shade sheet;

a pair of cables connected to opposite ends of the batten, said cables each being disposed in one of said channels into which the corded edges extend;

a pair of spring motor mounted on the sill, one motor being adjacent the bottom of each track, each motor being connected to a second end of one of said cables, said motors being biased to retract said shade sheet over the bay; and means for turning said take-up roller to roll up said shade sheet onto the roller agianst the action of said spring motors.

2. A retrofittable insulation system as defined in claim 1 wherein at least one of said tracks has two C-shaped channels facing away from each other, each of said channels having an opening, and wherein said one track further comprises a removable cover plate having flanges which engage sides of said channels facing away form said openings, said plate being spaced from said base for covering said base and fasteners used to secure said track to a glazing bar.

3. A retrofittable insulation system as defined in claim 1 wherein openings are provided through said base at selected intervals for receiving fasteners for securing said track to a glazing bar.

4. A retrofittable insulation system as defined in claim 1 further comprising a sill box adapted to be mounted on the sill of the window wall and extending between adjacent glazing bars, said spring motors being mounted within the sill box adjacent opposite ends thereof.

5. A retrofittable insulation system as defined in claim 4 wherein each of said spring motors includes a pair of parallel axles, one of said axles carrying a spring storage spool and idler sheave and the other of said axles carrying a spring spool and a cable spool.

6. A retrofittable insulation system as defined in claim 5 wherein each idler sheave has a vertical tangent aligned with a respective channel on an associated side of the bay to align the associated cable with its channel.

7. A retrofittable insulation system as defined in claim 1 wherein said turning means includes an electrical motor connected to said take-up roller rotating said roller.

8. A track for retrofittable insulation system for solar rooms comprising:

a flat base having parallel side edges, said base being adapted to be secured to a glazing bar in a solar room;

a pair of C-shaped channels connected to said base and disposed on one flat side of said base, one channel being adjacent each edge of said base, said channels having arc-shaped surfaces curved inwardly from the base toward each other; and a cover having arc-shaped flanges curved inwardly toward each other for releasably engaging said arc-shaped surfaces on said channels to hold said cover over said base;

said base, said channels and said cover each being formed of an extruded plastic material.

9. A track as defined in claim 8 wherein said C-shaped channels are open in directions facing away from one another.

10. A shade system for a window defined by a generally horizontally extending sill and at least two vertically extending glazing bars which define the sides of the window, said shade system comprising:

a pair of elongated tracks each secured to an inside surface of a glazing bar and extending substantially the full length of the glazing bar, said pair of tracks being secured to glazing bars on opposite sides of the window, each of said tracks having a channel having an opeing facing a corresponding channel opening in the other of said tracks;

a take-up roller carrying a shade sheet having a lower edge, said take-up roller being carried by brackets secured adjacent the top of each of the glazing bars;

a corded edge provided on each side edge of said shade sheet, each corded edge extending into a different one of said channels in said tracks;

a batten secured to said lower edge of said shade sheet;

a pair of variable torque spring motors disposed adjacent the sill for drawing the shade sheet downwardly over the window towards the sill;

a cable coiled on a spool connected to a controlled by each spring motor, one cable being connected to each end of said batten; and means for turning said take-up roller to roll up said shade sheet onto the roller against the action of said spring motors, said spring motors drawing said shade sheet downwardly over the window when said turning means is deactivated.

11. A shade system as defined in claim 10 wherein each of said variable torque spring motors comprises a spring configured so that the pull force provided by said spring motors as said cables are withdrawn from their spools is always a generally constant amount greater than the pull force required to draw said shade sheet over the window when said turning means is deactivated.

12. A shade system as defined in claim 11 wherein the pull force required to draw said shade sheet over the window is always at least one quarter pound less than the pull force provided by said spring motor.

13. A shade system as defined in claim 11 wherein the pull force provided by said spring motor is at a minimum when the cable is fully withdrawn from said spool.

14. A shade system as defined in claim 10 wherein said spring motor comprises a coiled spring deflected to have different radii of curvature at different points along its length.

15. A shade system for a window defined by a generally horizontally extending sill and at least two vertically extending glazing bars which define the sides of the window, said shade system comprising:

a pair of elongated tracks formed of an extruded, relatively strong plastic material, each of the glazing bars having one of said tracks being secured thereto on an inside facing surface thereof, said tracks each extending substantially the full length of their associated glaizng bars, each of said tracks having a channel having an opening facing a corresponding channel opening in the other of said tracks, said channels each having a wall thickness in the order of 0.08 inches;

a take-up roller carrying a shade sheet having a lower edge, said take-up roller being carried by brackets secured adjacent the top of each of the glazing bars;

a corded edge provided on each side edge of said shade sheet, each corded edge extending into a different one of said channels in said tracks;

retraction means for drawing the shade sheet downwardly over the window toward the sill; and activating means for turning the take-up roller to roll up the shade sheet onto the roller against the action of the retraction means.

16. A variable torque spring motor assembly for use with a shade system for a window, said spring motor assembly comprising:

a spring spool and a cable spool coaxially carried by a first axle and rotatable together on said first axle;

a storage spool and an idler sheave axially mounted on a second axle, said idler sheave and storage spool lying in the same plane;

a cable wound upon said cable spool and extending around said idler sheave;

means for mounting said first and second axles in parallel alignement; and a variable torque coiled spring wrapped about said storage spool in one direction and said spring spool in an opposite direction for urging said cable spool to rotate in a direction to roll up said cable on said cable spool.

17. A spring motor assembly as defined in claim 16 wherein said variable torque spring is deflected so that its radius of curvature varies from point to point along its length.

18. A retrofittable shade system for a window defined by a generally horizontally extending sill and at least two vertically extending glazing bars which define the sides of the window, said shade system comprising:

a pair of elongated tracks disposed on opposite sides of the window, each of said tracks being secured to an inside surface of an associated glazing bar and extending substantially the full length of its associated glazing bar, each of said tracks being sufficiently flexible so that each said track may be bent to conform to the figuration of its associated glazing bar, each of said tracks having a channel having an opening facing a corresponding channel opening in the other of said tracks and a base to facilitate securing of said track to its associated glazing bar;

a take-up roller carrying a shade sheet having a lower edge, said take-up roller being supported by brackets secured adjacent the top of each of the glazing bars;

a corded edge provided on each side of said shade sheet and extending into an associated one of said channels in said tracks;

a batten secured to said lower edge of said shade sheet;

a cable connected to said batten;

means disposed adjacent the bottom of said tracks and connected to said cable for retracting said shade sheet over the window; and means for turning said take-up roller to roll up said shade sheet onto the roller against the action of said retracting means.

19. A track for retrofittable insulation system for solar rooms comprising:

a flat base having parallel side edges, said base being adapted to be secured to a glazing bar in a solar room;

a pair of C-shaped channels connected to said base and disposed on one flat side of said base, one channel being adjacent each edge of said base, said channels having arc-shaped surfaces curved inwardly from the base toward each other; and a cover having arc-shaped flanges curved inwardly toward each other for releasably engaging said arc-shaped surfaces on said channels to hold said cover over said base;

said base, said channels and said cover each being formed of a material sufficiently flexiable so that each one thereof may be bent to conform to the configuration of the glazing bar.

* * * * *